US010100663B2

(12) United States Patent
Longworth et al.

(10) Patent No.: US 10,100,663 B2
(45) Date of Patent: Oct. 16, 2018

(54) ACTUATION ARRANGEMENT

(71) Applicant: ROLLS-ROYCE plc, London (GB)

(72) Inventors: David M Longworth, Stockport (GB); Jonathan A Jarvis, Bristol (GB); Jonathan A Cherry, Bristol (GB); Hugh J Blakemore, Bristol (GB); John R Webster, Derby (GB)

(73) Assignee: ROLLS-ROYCE plc, London (GB)

( * ) Notice: Subject to any disclaimer, the term of this patent is extended or adjusted under 35 U.S.C. 154(b) by 393 days.

(21) Appl. No.: 15/155,359

(22) Filed: May 16, 2016

(65) Prior Publication Data

US 2016/0356173 A1 Dec. 8, 2016

(30) Foreign Application Priority Data

Jun. 4, 2015 (GB) ..... 1509707.4

(51) Int. Cl.
*F01D 17/14* (2006.01)
*F04D 29/56* (2006.01)
*F01D 17/16* (2006.01)

(52) U.S. Cl.
CPC ..... *F01D 17/162* (2013.01); *F04D 29/563* (2013.01); *F05D 2300/505* (2013.01)

(58) Field of Classification Search
CPC .. F01D 17/162; F04D 29/563; F05D 2250/90; F05D 2300/505
See application file for complete search history.

(56) References Cited

U.S. PATENT DOCUMENTS 2,677,273 A 5/1954 Johnson
5,463,514 A 10/1995 Yaeger
(Continued)

FOREIGN PATENT DOCUMENTS

CN 202428438 U 9/2012
GB 1049561 A 11/1966
(Continued)

OTHER PUBLICATIONS

Aug. 8, 2016 Search Report issued in British Patent Application No. GB 1608521.9.
(Continued)

*Primary Examiner* — Ninh H Nguyen
(74) *Attorney, Agent, or Firm* — Oliff PLC

(57) ABSTRACT

An actuation arrangement for effecting actuation of pivotable vane, for example, variable inlet guide vane in gas turbine engine. The actuation arrangement includes an actuator having a support plate and pivotable plate. The pivotable plate is fixedly connected to pivotable vane and pivotable plate and pivotable vane are pivotable about a pivot axis. The actuator further includes at least one actuation element having a length extending from support plate to proximal a transverse edge portion of pivotable plate substantially perpendicular to pivot axis. The or each actuation element is fixedly connected to each of the support and pivotable plates and formed of a material that changes dimension upon application of external energy. Thus, upon application of external energy, for example, heat, a change in length of the or each actuation element occurs such that change in length effects pivoting of pivotable plate and pivotable vane about the pivot axis.

14 Claims, 4 Drawing Sheets

(56) References Cited

U.S. PATENT DOCUMENTS

| | | | | |
|---|---|---|---|---|
| 5,990,777 | A | 11/1999 | Whiteman, Jr. | |
| 7,644,575 | B2 * | 1/2010 | Wood | B64C 7/02 60/204 |
| 9,394,804 | B2 * | 7/2016 | Rusovici | F01D 17/162 |
| 2003/0089109 | A1 | 5/2003 | Park | |
| 2009/0232636 | A1 * | 9/2009 | Grauer | F01D 5/145 415/58.5 |
| 2010/0329851 | A1 * | 12/2010 | Nilsson | F01D 5/148 415/151 |
| 2012/0045318 | A1 * | 2/2012 | LaMaster et al. | F04D 29/023 415/151 |
| 2014/0286745 | A1 | 9/2014 | Rusovici | |

FOREIGN PATENT DOCUMENTS

| | | | |
|---|---|---|---|
| JP | 558-93903 | A | 6/1983 |
| JP | S61-72803 | A | 4/1986 |
| JP | 2007-155148 | A | 6/2007 |
| WO | 00/41501 | A2 | 7/2000 |
| WO | 03/083957 | A2 | 10/2003 |

OTHER PUBLICATIONS

Nov. 23, 2015 Search Report issued in British Patent Application No. GB1509707.4.

* cited by examiner

ACTUATION ARRANGEMENT

This disclosure claims the benefit of UK Patent Application No. 1509707.4, filed on 4 Jun. 2015, which is hereby incorporated herein in its entirety.

FIELD OF THE DISCLOSURE

The present disclosure relates to an actuation arrangement for effecting rotation of a pivotable vane and, in particular, to an actuation arrangement for control of a variable inlet guide vane or a variable stator vane in a gas turbine engine.

BACKGROUND OF THE DISCLOSURE

During operation of a gas turbine engine using a multi-stage axial compressor, the turbine rotor is turned at high speed by the turbine so that air is continuously introduced into the compressor, accelerated by the rotating blades and swept rearwards onto an adjacent row of stator vanes.

Inlet guide vanes are used to channel air into the compressor and the stator vanes correct the deflection given to the air by the rotor blades and present the air at the correct angle to the next stage of rotor blades.

It is known to provide variable inlet guide vanes (VIGVs) and variable stator vanes (VSVs) which have an adjustable angular deflection.

The manner of operation of a known variable vane system is described with reference to FIG. 1 which shows a cutaway side view of part of a compressor section of an aircraft gas turbine engine.

In FIG. 1 there is shown the compressor section 10 of an aircraft gas turbine engine. Sets of vanes 14 are circumferentially mounted on a tubular casing 12 about the central axis of the compressor section. A corresponding set of rotor vanes 16 is mounted downstream of each set of vanes 14. Each vane 14 terminates at the casing 12 in a stem 18 pivotable in a bush bearing 20 on the outside of the casing, the end of the stem 18 extending beyond the bush 20.

Located externally of the casing 12 and adjacent each set of vanes 14 are actuator rings 22 (also known as unison rings) extending circumferentially around the tubular casing 12. The vane stem 18 of each vane is connected to the corresponding actuator ring 22 by means of an actuating lever 24. One end of the actuating lever 24 is clamped to the end of the vane stem 18 by means of a bolt 26 so that there is no relative movement between the stem and the lever. The other end of the lever 24 is connected to the actuator ring 22 by a pin 28 which is pivotable in a bush bearing located in the actuator ring.

The actuator ring 22 is arranged so that it may be rotated in a circumferential direction about the central axis of the compressor section, for example, in either direction of arrow 9. Consequently, rotation of the actuator ring 22 will, by means of the actuating levers 24, cause rotation of each vane 14 about its own axis and thus enable the vanes 14 to assume pre-determined angles of incidence to the incoming air.

The known prior art systems are designed to effect a uniform angular deflection of all vanes 14 in a set upon rotation of the actuator ring 22. This uniform angular deflection has been found to result in engine vibrations which can causes damage and wear on the engine. Furthermore, the uniform angular deflection is unable to counter pressure variations in the air flow through the compressor. Another problem with the known systems is that angle variations can occur as a result of slack in the fittings in the unison ring and this can lead to pressure variations and, consequently, a reduction in the compressor efficiency.

There is a desire to provide an actuation arrangement that allows for individual deflection of a variable vane (for example, a VIGV or a VSV) to effect non-uniform deflection or to correct undesired non-uniformity introduced by slack in unison ring fittings across a set of variable vanes to reduce gas turbine engine vibration and to accommodate variations in the pressure of the air flow through the compressor.

SUMMARY OF THE DISCLOSURE

In a first aspect, the present disclosure provides an actuation arrangement for effecting actuation of a pivotable vane, said actuation arrangement comprising an actuator having:

- a support plate;
- a pivotable plate fixedly connected to the pivotable vane, the pivotable plate and pivotable vane being pivotable about a pivot axis;
- wherein the actuator further comprises at least one actuation element having a length extending from the support plate to proximal a transverse edge portion of the pivotable plate substantially perpendicular to the pivot axis, the or each actuation element being fixedly connected to each of the support and pivotable plates and formed of a material that changes dimension upon application of external energy to effect a change in the length of the or each actuation element such that the change in length effects pivoting of the pivotable plate and pivotable vane about the pivot axis.

By providing each vane in a set of variable vanes in a gas turbine engine with an actuation arrangement as described above, for example, having at least one actuation element fixedly connected between a support plate and a pivotable plate and that changes length upon application of external energy, the angular deflection of each vane can be independently controlled thus reducing engine vibrations and allowing accommodation of variations in pressure of the air flow through the compressor.

Optional features of the disclosure will now be set out. These are applicable singly or in any combination with any aspect of the disclosure.

The or each actuation element may be formed, for example, of a shape memory alloy material (for example, a heat responsive shape memory alloy) or a piezoelectric material.

A shape memory alloy (SMA) material is one that when deformed (for example, stretched), returns to its original shape upon heating (for heat-sensitive SMAs). An SMA may exhibit a one-way memory effect (where the SMA can be deformed and will hold its shape until heating when it returns to the original shape), or a two-way memory effect (where the SMA can "remember" two different shapes). The or each actuation element may be formed of a copper-based or Ni—Ti-based SMA.

A piezoelectric material is one that changes dimension upon application of an external electric field.

In some embodiments, the actuator comprises a first and a second actuation element extending from the support plate to proximal opposing transverse edges of the pivotable plate, for example, on opposite sides of the pivot axis.

The first and second actuation element may be an antagonistic pair, for example, when one increases in length, the other reduces in length.

In some embodiments, the first actuation element and a second actuation element may each be formed of an SMA, for example, a one-way SMA. In these embodiments, the pivotable plate is movable between a first position in which the first actuation element is deformed (longer) to a second position which the second actuation element is deformed (longer).

By providing an antagonistic pair of actuation elements formed of an SMA, each SMA actuation element can be selectively activated (for example, through heating) to cause contraction of the activated SMA actuation element, the contraction causing elongation of the un-activated SMA actuation element In the present disclosure, the pivotable plate is movable from a first position in which the first actuation element is deformed (stretched) to a second position in which the second actuation element is deformed (stretched) by activating (for example, heating) the first actuation element so that it contracts. The contraction of the first actuation element will pivot the pivotable plate and pivotable vane causing elongation of the second actuation element.

In some embodiments, the pivotable plate is moveable from a first position in which the first actuation element is deformed (for example, fully deformed) and the second actuation element is un-deformed to the second position in which the second actuation element is deformed (for example, fully deformed) and the first actuation element is un-deformed, for example, the two actuation elements are an antagonistic pair of SMA actuation elements. In these embodiments, the pivotable plate is moveable from the first position to the second position through a nominal position in which both actuation elements are partly deformed and of equal length.

In some embodiments, each SMA actuation element is selected to have an original (un-deformed) length such that the pivotable plate rotates through a 5 degree angle from the nominal position in which the first and second SMA actuation elements are of equal length upon activation.

In some embodiments, the actuator further comprises a support arm extending between the pivotable and support plates. A first end of the support arm is fixedly connected to the support plate. A second end of the support arm is pivotally connected to the pivotable plate. In embodiments with an antagonistic pair of actuation elements, the support arm may be interposed between the two actuation elements.

In some embodiments, the support arm includes a rotation limiter proximal the second end of the support arm for limiting rotational movement of the pivotable plate relative to the support arm. This is to prevent over-straining of the actuation element(s) in the event of a pressure overload on the pivotable vane.

In some embodiments, a spacing between the first ends of the first and second actuation elements (fixed to the support plate), and the spacing between the second ends of the first and second actuation elements (fixed to the pivotable plate) are equal.

In some embodiments, the actuation element(s) and support arm are parallel to one another.

In some embodiments, the actuation arrangement comprises the pivotable vane which may be a variable inlet guide vane (VIGV) or a variable stator vane (VSV).

In some embodiments, the pivotable vane may comprise a mounting stem, and the pivotable plate is fixedly connected to the mounting stem. For example, the pivotable plate may comprise a bore into which the pivotable vane/mounting stem is inserted and fixed, for example, using a locking member.

The bore may extend through the second end of the support arm such that the pivotable vane/mounting stem extends through the support arm with the support arm being pivotable about the pivotable vane/mounting stem.

In some embodiments, the arrangement further includes a tubular casing and the pivotable vane is pivotally mounted to the tubular casing. In these embodiments, the support plate may be fixed relative to the axis of the tubular casing.

In some embodiments, the support plate may be moveable about the circumference of the tubular casing.

In some embodiments, the actuation arrangement further comprises an actuation ring (or unison ring) at least partially circumscribing and rotatable about the circumference of the tubular casing. The support plate may be fixedly mounted to the actuation ring. The support plate may be pivotable on the actuation ring about an axis perpendicular to the axis of the tubular casing. The fixed connection between the support arm and the support plate prevents pivoting of the support plate on the actuation ring upon actuation of the actuation element(s).

The actuation ring can be used to adjust the angular deflection of the pivotable vaneby transferring the rotational force through the or each actuation element with further adjustments being possible for each pivotable vane using the actuation arrangement of the present disclosure.

In some embodiments, the or each actuation element is fixedly connected at opposing ends to the pivotable and support plates using a clamping mechanism. For example, an end of the or each actuation element may be clamped again its respective plate by a clamping/fixing plate secured to the respective plate.

In some embodiments, the actuation arrangement further comprises a device for applying external energy to the or each actuation element. For example, where the or each actuation element is a heat responsive SMA, the actuation arrangement may further comprise a heating device for selectively heating the SMA actuation elements, for example, by passing a current through one or other or both of the SMA actuation elements.

In some embodiments, the actuation arrangement comprises a plurality of actuators, each actuator for actuating a respective pivotable vane. The plurality of actuators may all be circumferentially-spaced around the actuator ring. In a second aspect, the present disclosure provides an axial multi-stage compressor comprising an actuation arrangement according to the first aspect.

In a third aspect, the present disclosure provides a gas turbine engine comprising an axial multi-stage compressor according to the second aspect.

BRIEF DESCRIPTION OF THE DRAWINGS

Embodiments of the disclosure will now be described by way of example with reference to the accompanying drawings in which.

DETAILED DESCRIPTION AND FURTHER OPTIONAL FEATURES OF THE DISCLOSURE

Figure 2:
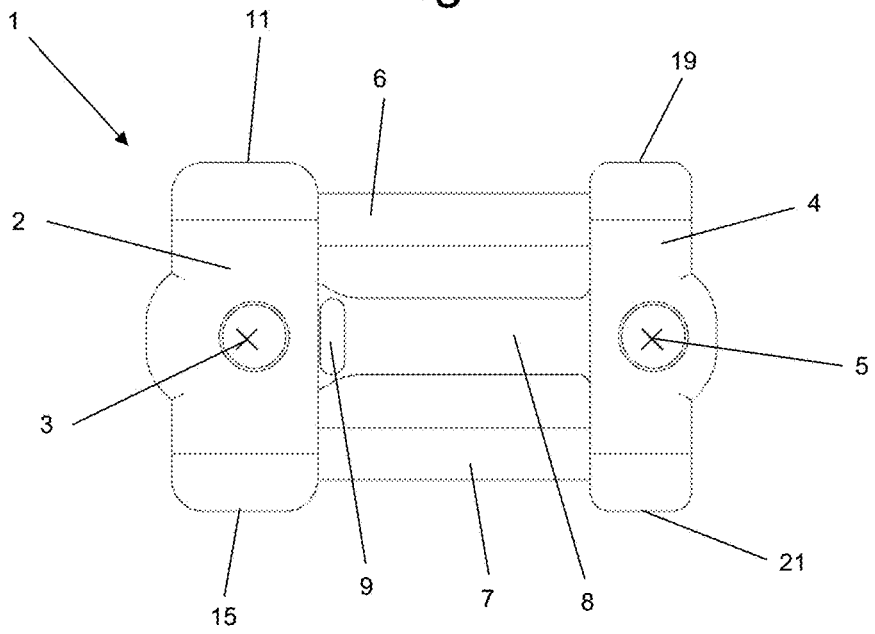
FIG. 2 shows an actuator for an actuation arrangement according to a first embodiment of the present disclosure with the pivotable vane in a nominal rest position.

As shown in FIG. 2, an actuator 1 for an actuation arrangement for effecting actuation of a variable inlet guide vane (VIGV) (not shown) comprises a pivotable plate 2 which is fixedly connected to a mounting stem 23 (shown in FIG. 4) of the VIGV.

Figure 1:
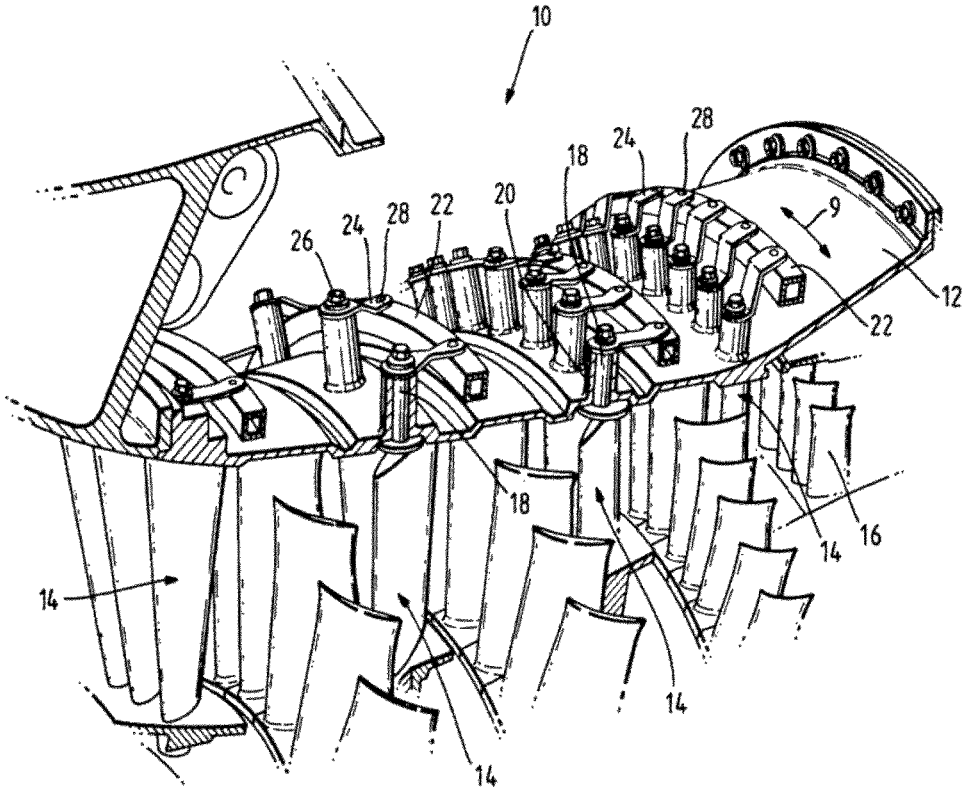
FIG. 1 shows a compressor section of an aircraft gas turbine engine.
Figure 3:
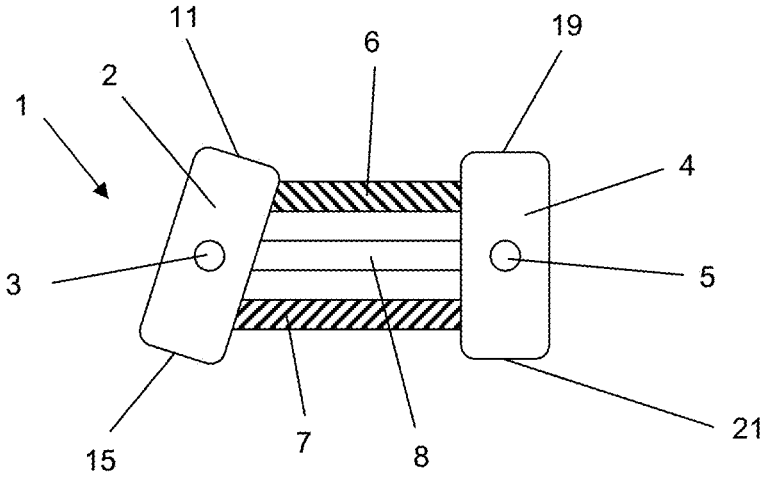
FIG. 3 shows the actuator for the actuation arrangement of FIG. 2, with the pivotable vane rotated from the nominal rest position.

Although not shown in FIGS. 2 and 3, the actuation arrangement comprises a tubular casing and an actuation ring which are as described for the prior art arrangement shown in FIG. 1.

The pivotable plate 2 and VIGV are each mounted on the tubular casing and are pivotable about a pivot axis 3.

Figure 4:
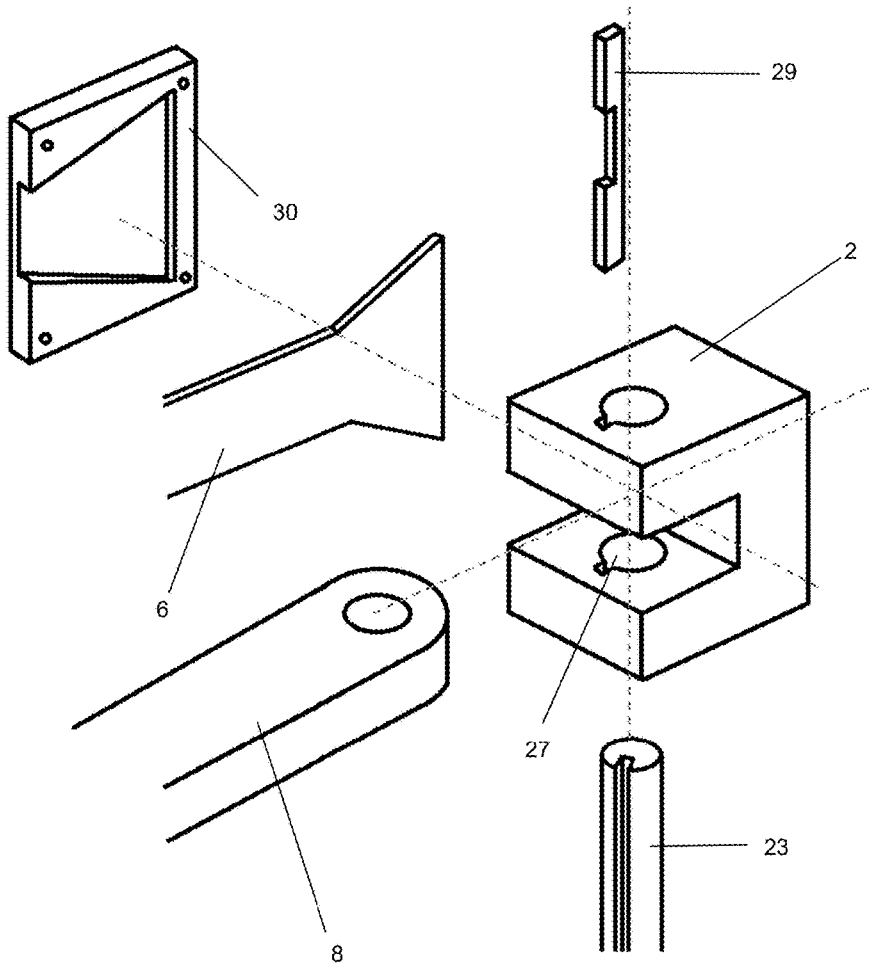
FIG. 4 shows details of the connection of the actuation element and support arm to the pivotable plate.

The actuator further comprises a support plate 4 which is pivotably connected to the actuator ring and is pivotable about a second pivot axis 5. The support plate 4 is rotatable about the circumference of the tubular casing with the actuator ring (at a fixed position along the axis of the tubular casing). A support arm 8 extends between the pivotable plate 2 and support plate 4. A first end of the support arm 8 is fixedly connected to the support plate. A second end of the support arm 8 is pivotally connected to the mounting stem 23 of the VIGV. As shown in FIG. 4, the pivotable plate 2 comprises a slot 25 for receiving the second end of the support arm. Once inserted, a bore 27 extends though the pivotable plate 2 and support arm 8 for receiving the mounting stem 23. A locking member 29 secures the mounting stem 23 to the pivotable plate 2 within the bore but allows pivoting of the support arm 8 about the mounting stem 23 relative to the pivotable plate 2.

The actuator further comprises a first actuation element 6 extending from proximal a first transverse end 11 of the pivotable plate 2 to proximal the first transverse end 19 of the support plate 4 substantially perpendicular to the pivot axis 3. A second actuation element 7 extends from proximal the opposing transverse end 15 of the pivotable plate 2 to proximal the opposing transverse end 21 of the support plate 4 substantially perpendicular to the pivot axis 3.

There is a constant spacing between the first actuation element 6 and second actuation element 7 as they extend between the pivotable and support plates 2, 4. The support arm 8 is interposed midway between the first and second SMA actuation elements 6, 7. The pivot axis 3 is positioned on the pivotable plate 2 midway between the transverse ends 11, 15.

The first and second actuation elements 6, 7 are fixedly connected to each of the support and pivotable plates 2, 4 by respective clamping mechanisms. As shown in FIG. 4, the second actuation element 7 is affixed to the transverse end 15 of the pivotable plate 2 by a fixing plate 30 that has a recess for receiving the second end of the second actuation element 7. The second end of the second actuation element is sandwiched and secured between the fixing plate 30 and the pivotable plate 2.

The first and second actuation elements 6, 7 are formed of a copper-based or Ni—Ti-based shape memory alloy material. A shape memory alloy (SMA) material is one that when deformed (for example, stretched), returns to its original shape upon heating.

The actuation mechanism further comprises a heating mechanism (not shown) for selectively heating the SMA actuation elements 6, 7, for example, by passing a current through one or other of the SMA actuation elements 6, 7.

In use, the actuation ring can be used to adjust the angular deflection of the VIGV in the normal manner, with rotation of the actuation ring about the circumference of the tubular casing, with the rotational loads being transferred through the actuation elements 6,7.

When individual adjustment of a VIGV is required, the actuator 1 can be used to pivot the pivotable plate 2 and thus the VIGV. To effect pivoting of the pivotable plate 2, as shown in FIG. 3, the first SMA actuation element 6 is heated by passing a current through it. This heating causes the first SMA actuation element to contract thus pulling the first transverse end of the pivotable plate towards the support plate 4. In doing so, the pivotable plate 2 and VIGV are rotated about the pivot axis 3. This causes a stretching of the second SMA actuation element 7 which can subsequently be reversed by heating. This causes the pivotable plate 2 to pivot back in an opposite direction about the pivot axis 3.

The support arm 8 includes a rotation limiter 9 proximal the first end of the support arm 8 for limiting rotational movement of the pivotable plate 2 relative to the support arm 8. This helps prevent over-straining of the SMA actuation elements 6, 7 in the event of a pressure overload on the VIGV.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the scope of the disclosure.

What is claimed is:

1. An actuation arrangement for effecting actuation of a pivotable vane in a gas turbine engine, said actuation arrangement comprising an actuator having:

a support plate;

a pivotable plate fixedly connected to the pivotable vane, the pivotable plate and pivotable vane being pivotable about a pivot axis;

wherein the actuator further comprises at least one actuation element having a length extending from the support plate to proximal a transverse edge portion of the pivotable plate substantially perpendicular to the pivot axis, the or each actuation element being fixedly connected to each of the support and pivotable plates and formed of a material that changes dimension upon application of external energy to effect a change in the length of the or each actuation element such that the change in length effects pivoting of the pivotable plate and pivotable vane about the pivot axis.

2. The actuation arrangement according to claim 1, wherein the or each actuation element is formed of a shape memory alloy (SMA) material or a piezoelectric material.

3. The actuation element according to claim 1, wherein the actuator comprises a first and a second actuation element extending from the support plate to proximal opposing transverse edges of the pivotable plate substantially perpendicular to the pivot axis.

4. The actuation element according to claim 3, wherein the first actuation element and the second actuation element are each formed of an SMA and the pivotable plate is movable between a first position in which the first actuation element is deformed to a second position in which the second actuation element is deformed.

5. The actuation arrangement according to claim 4, wherein, in the first position, the second actuation element is un-deformed and in the second position, the first actuation element is un-deformed.

6. The actuation arrangement according to claim 1, wherein the actuator further comprises a support arm extending between the pivotable and support plates, a first end of the support arm fixedly connected to the support plate and a second end of the support arm pivotally connected to the pivotable plate.

7. The actuation arrangement according to claim 6, wherein the support arm includes a rotation limiter proximal the second end of the support arm for limiting rotational movement of the pivotable plate relative to the support arm.

8. The actuation arrangement according to claim 1, further comprising a variable inlet guide vane (VIGV) or a variable stator vane (VSV) as the pivotable vane.

9. The actuation arrangement according to claim 1, further comprising a tubular casing with the pivotable vane pivotally mounted to the tubular casing.

10. The actuation arrangement according to claim 9, further comprising an actuation ring at least partially circumscribing and rotatable about the circumference of the tubular casing with the support plate mounted to the actuation ring.

11. The actuation arrangement according to claim 1, further comprising a device for applying external energy to the or each actuation element.

12. The actuation arrangement according to claim 1, comprising a plurality of actuators, each actuator for actuating a respective pivotable vane.

13. An axial multi-stage compressor comprising an actuation arrangement according to claim 1.

14. A gas turbine engine comprising an axial multi-stage compressor according to claim 13.

* * * * *